US007568260B2

(12) United States Patent
Wu

(10) Patent No.: US 7,568,260 B2
(45) Date of Patent: Aug. 4, 2009

(54) DISCRETIONARILY ADJUSTABLE FRICTION BLOCK AND TACKLE BALANCE SYSTEM AND USES THEREOF

(76) Inventor: Mingze Wu, 47-32 162$^{nd}$ St., Flushing, NY (US) 11358

( * ) Notice: Subject to any disclaimer, the term of this patent is extended or adjusted under 35 U.S.C. 154(b) by 571 days.

(21) Appl. No.: 11/158,561

(22) Filed: Jun. 22, 2005

(65) Prior Publication Data

US 2005/0283944 A1 Dec. 29, 2005

Related U.S. Application Data

(60) Provisional application No. 60/582,443, filed on Jun. 24, 2004.

(51) Int. Cl.
*E05D 13/00* (2006.01)

(52) U.S. Cl. ..... 16/197; 49/181; 49/445

(58) Field of Classification Search ..... 16/197, 16/196, 199, 198, 200, DIG. 16; 49/445, 49/446, 181, 404, 414, 419
See application file for complete search history.

(56) References Cited

U.S. PATENT DOCUMENTS

| | | | | | |
|---|---|---|---|---|---|
| 2,336,406 | A | * | 12/1943 | Kreuscher | 16/197 |
| 2,950,509 | A | * | 8/1960 | Stavenau | 49/251 |
| 3,055,044 | A | | 6/1962 | Dinsmore | |
| 3,054,152 | A | | 9/1962 | Trammell | |
| 3,358,403 | A | | 12/1967 | Dinsmore | |
| 3,358,404 | A | * | 12/1967 | Dinsmore | 49/446 |
| 3,466,806 | A | * | 9/1969 | Bruyn et al. | 49/445 |
| 3,501,867 | A | * | 3/1970 | Scott | 49/421 |
| 3,722,142 | A | * | 3/1973 | Anderberg et al. | 49/248 |
| 4,068,406 | A | | 1/1978 | Wood | |
| 4,089,085 | A | | 5/1978 | Fitzgibbon | |
| 4,517,766 | A | | 5/1985 | Haltof | |
| 4,654,928 | A | | 4/1987 | Flight | |
| 4,697,304 | A | | 10/1987 | Overgard | |
| 5,251,402 | A | * | 10/1993 | Richardson et al. | 49/404 |
| 6,041,475 | A | * | 3/2000 | Nidelkoff | 16/193 |

* cited by examiner

*Primary Examiner*—Chuck Y. Mah
(74) *Attorney, Agent, or Firm*—Law Offices of Albert Wai-Kit Chan, PLLC

(57) ABSTRACT

Disclosed is a discretionarily adjustable friction force block and tackle balance system comprising a housing and an adjustable break, wherein means are provided for adjusting the friction force between an inner surface of the housing and the adjustable break. An adjustable balance system comprising a housing, a floating anchor assembly, a fixed anchor assembly, a cord, and an elastic suspension is also disclosed. In an embodiment, the housing is a 3-side or 4-side tube or channel. There is at least one elongated hole or slit on at least one surface of said housing. An adjustable break is mounted inside the floating anchor subassembly. Moving the window sash also causes the floating anchor subassembly to move. When the floating anchor subassembly is moved to a position just under elongated hole on the said housing, the adjust screw installed in the adjustable break is exposed. The desired friction force can be easily created and adjusted by turning the adjust screw in the appropriate direction to splay or retract the adjustable break for balancing window sashes having widely varying sizes and weights.

20 Claims, 11 Drawing Sheets

*U-shaped tube*

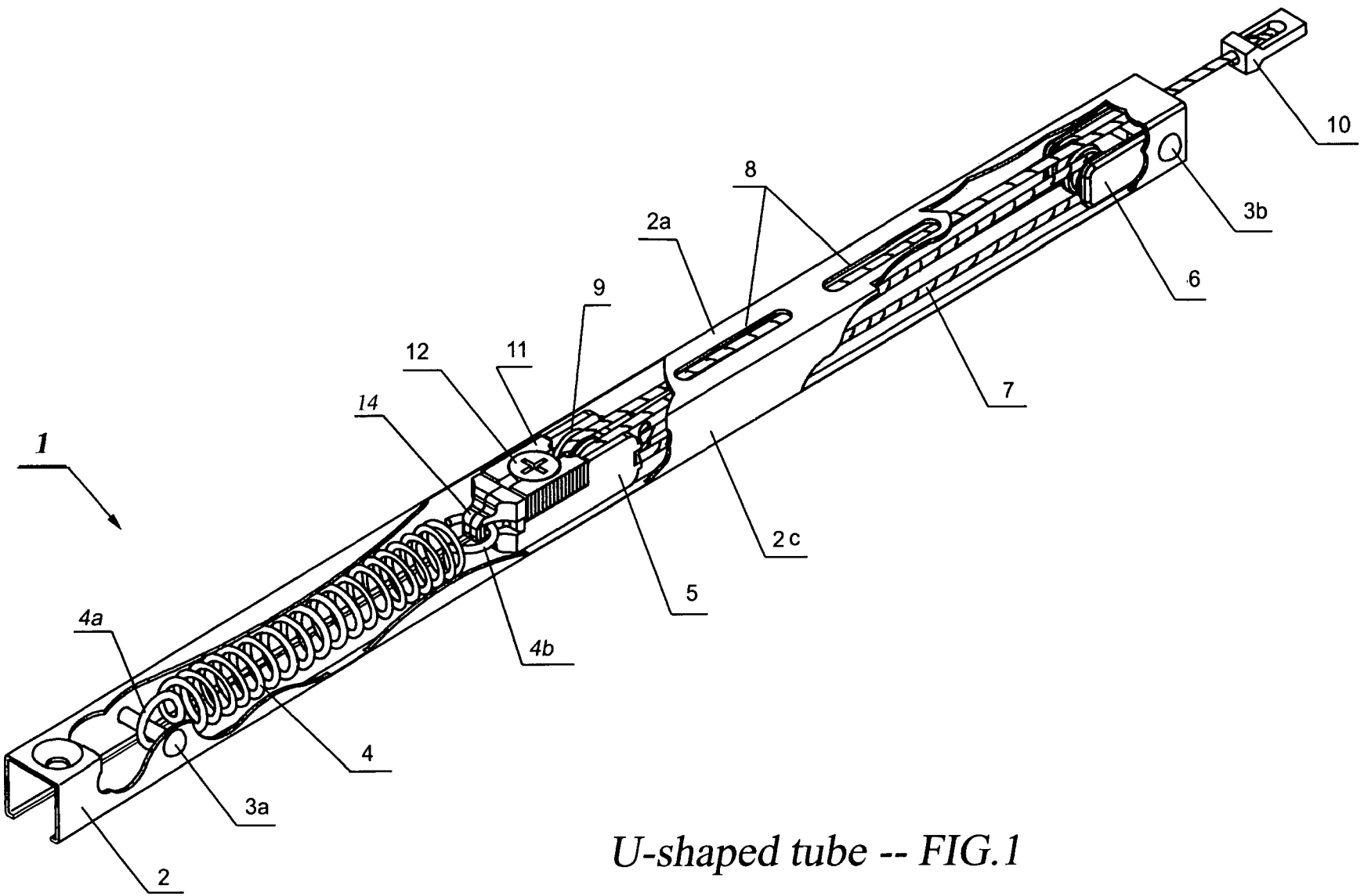
U-shaped tube -- FIG.1

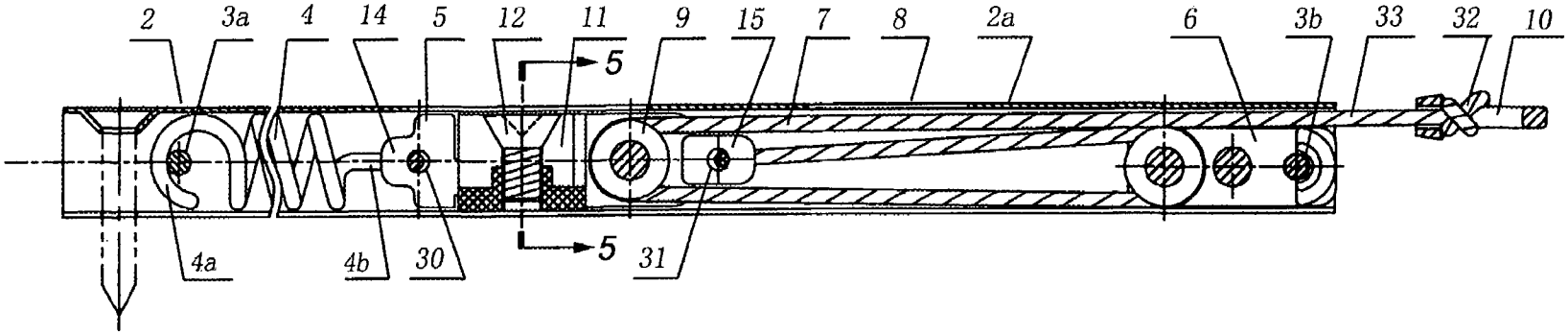
U-shaped tube --FIG.3
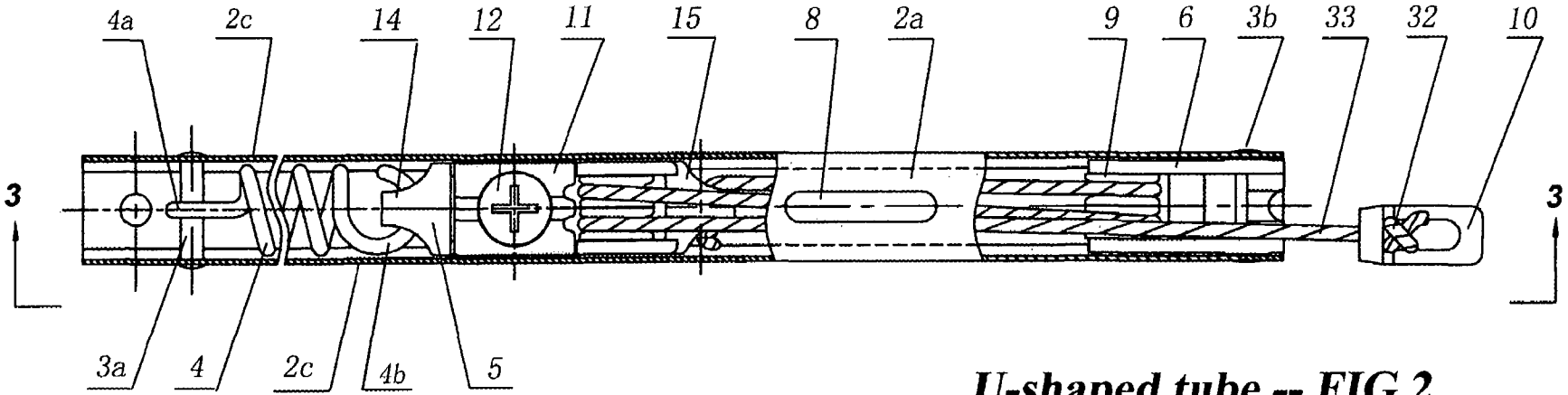
U-shaped tube -- FIG.2

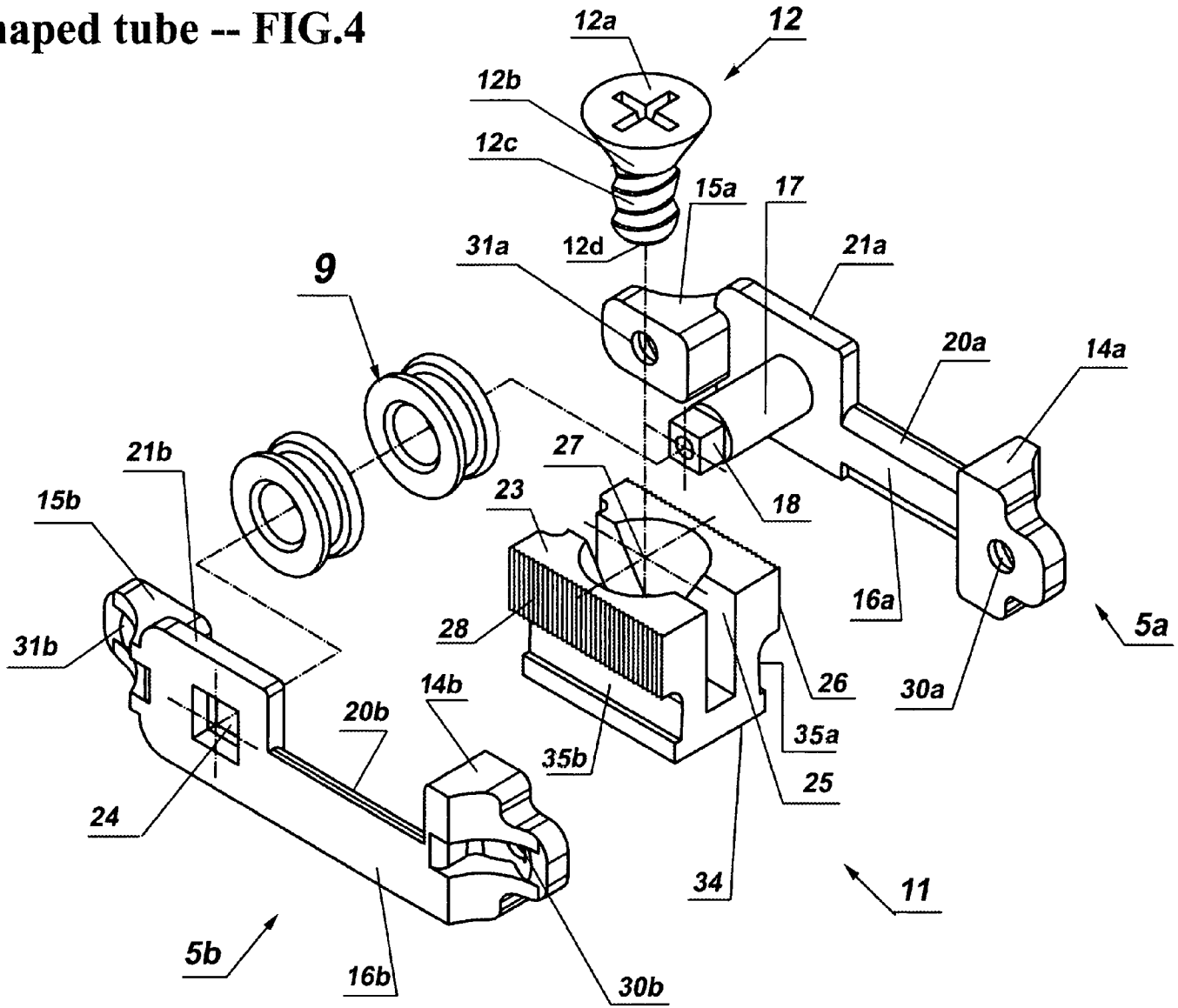
U-shaped tube -- FIG.4

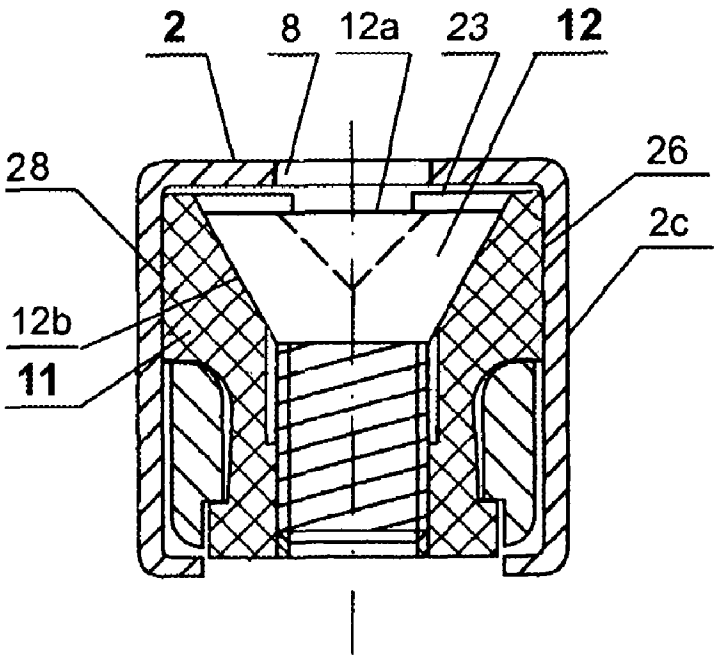
U-shaped tube -- FIG.6
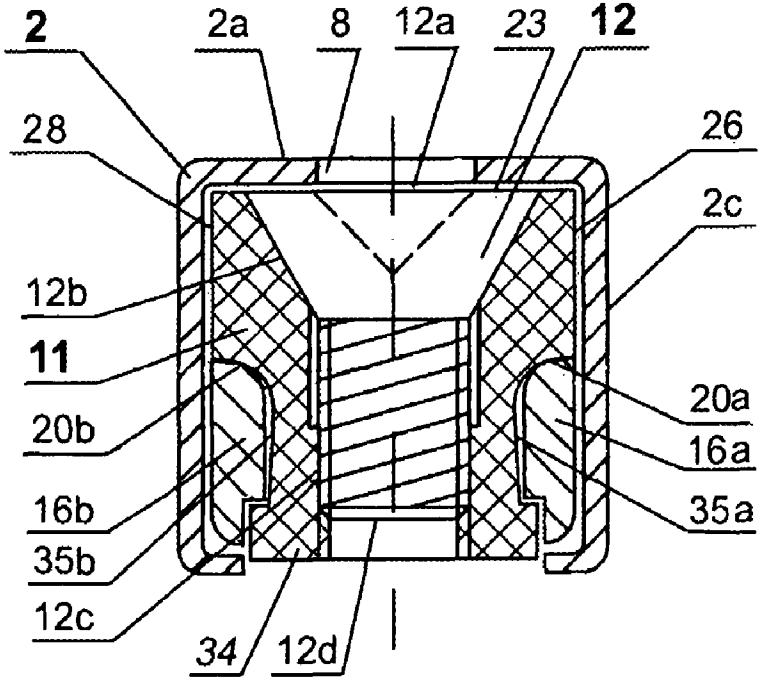
U-shaped tube -- FIG. 5

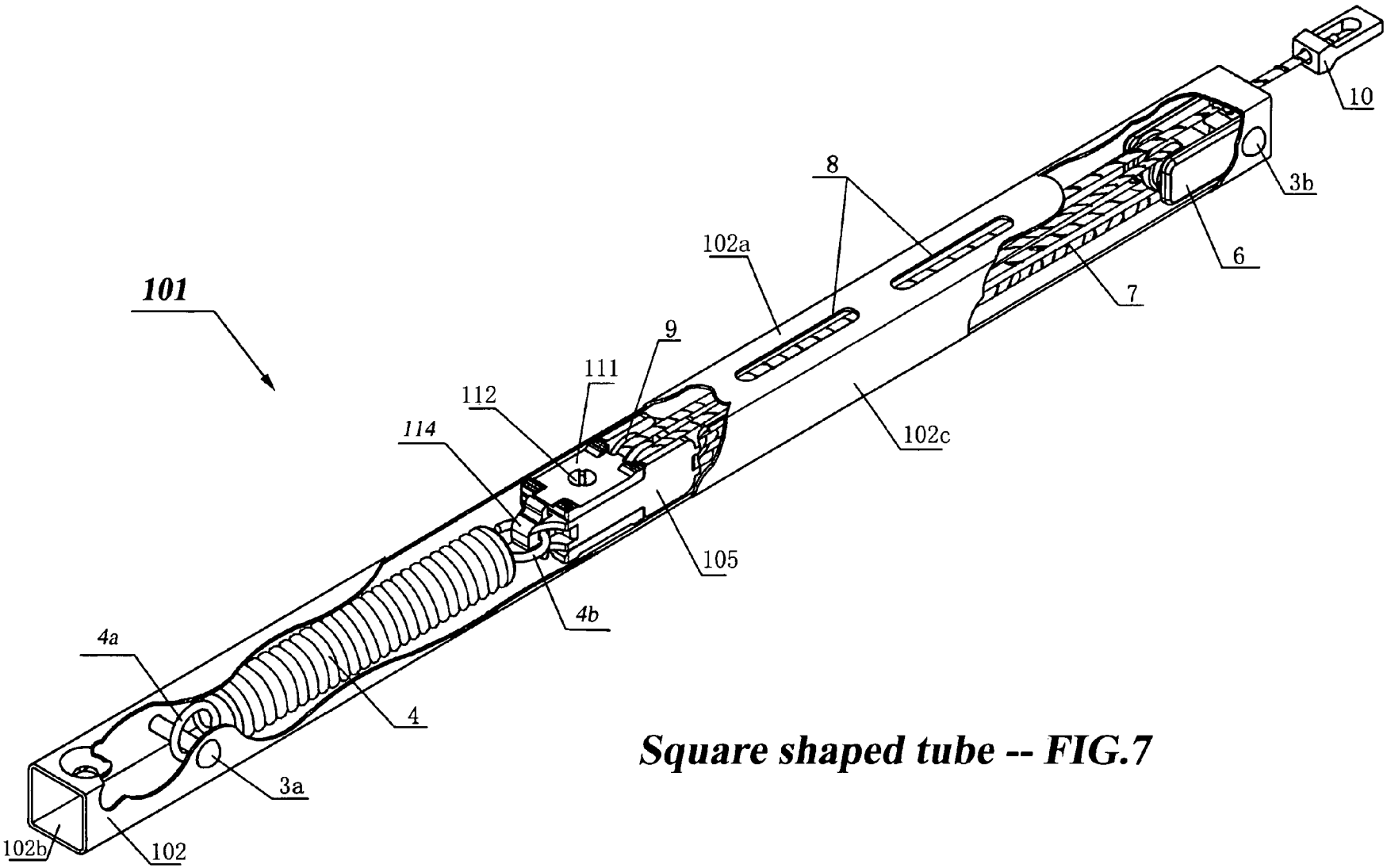
Square shaped tube -- FIG.7

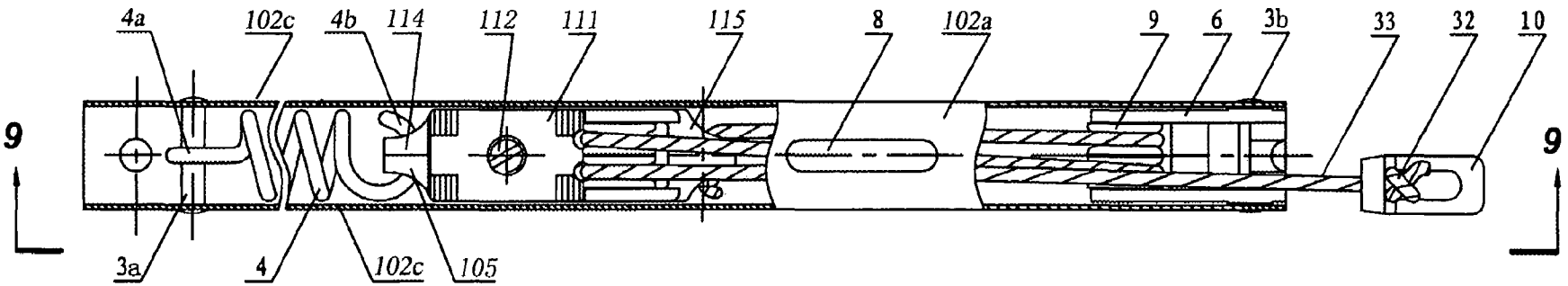
Square Shaped tube -- FIG.8

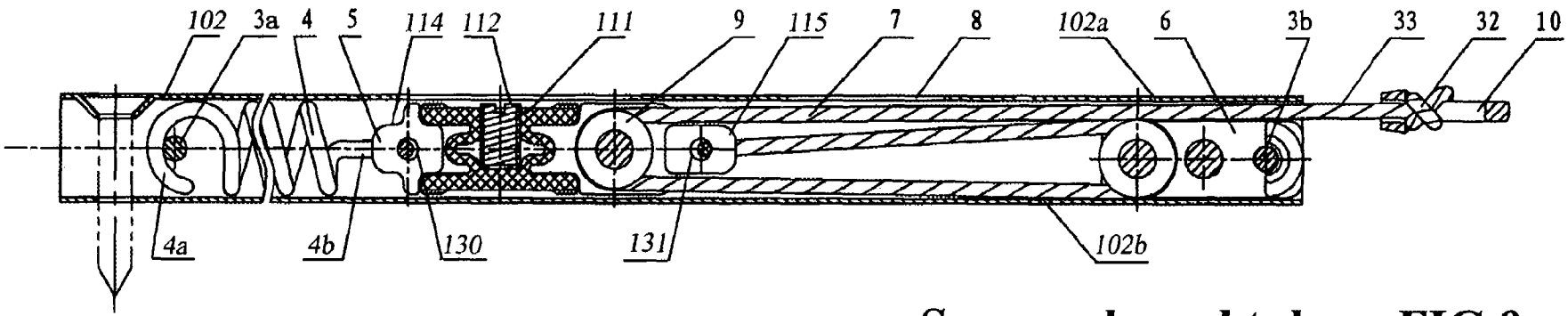
Square shaped tube -- FIG.9

Square shaped tube -- FIG.10
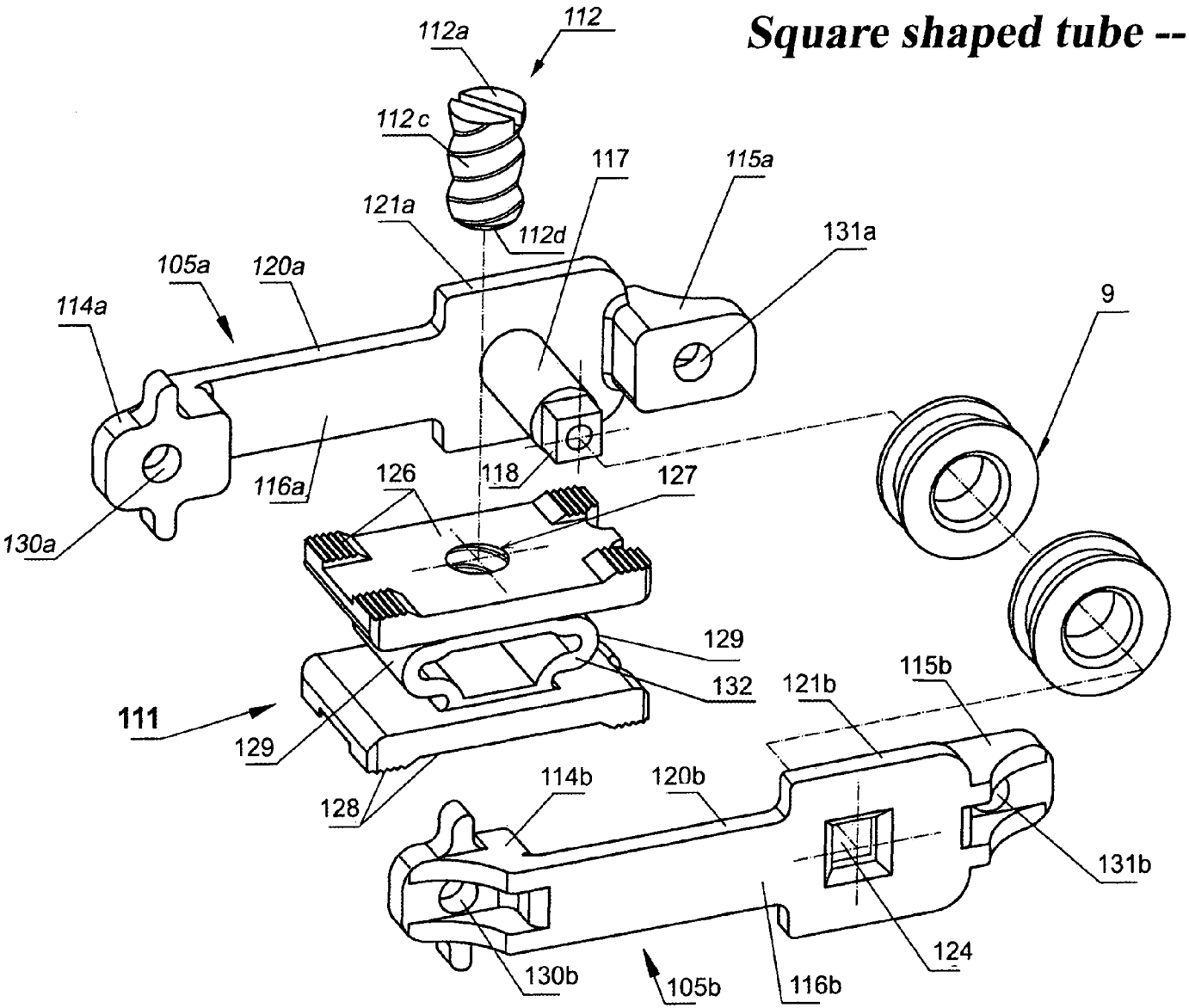

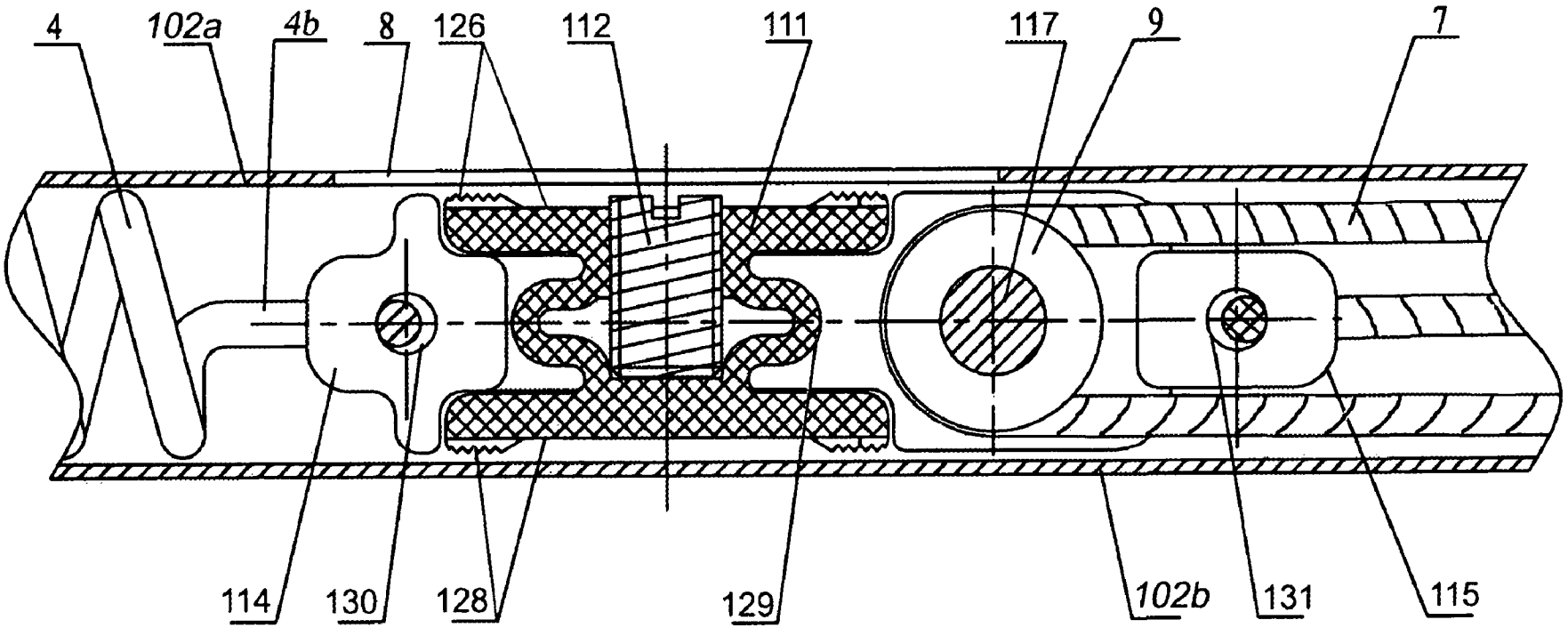
Square shaped tube -- FIG.11

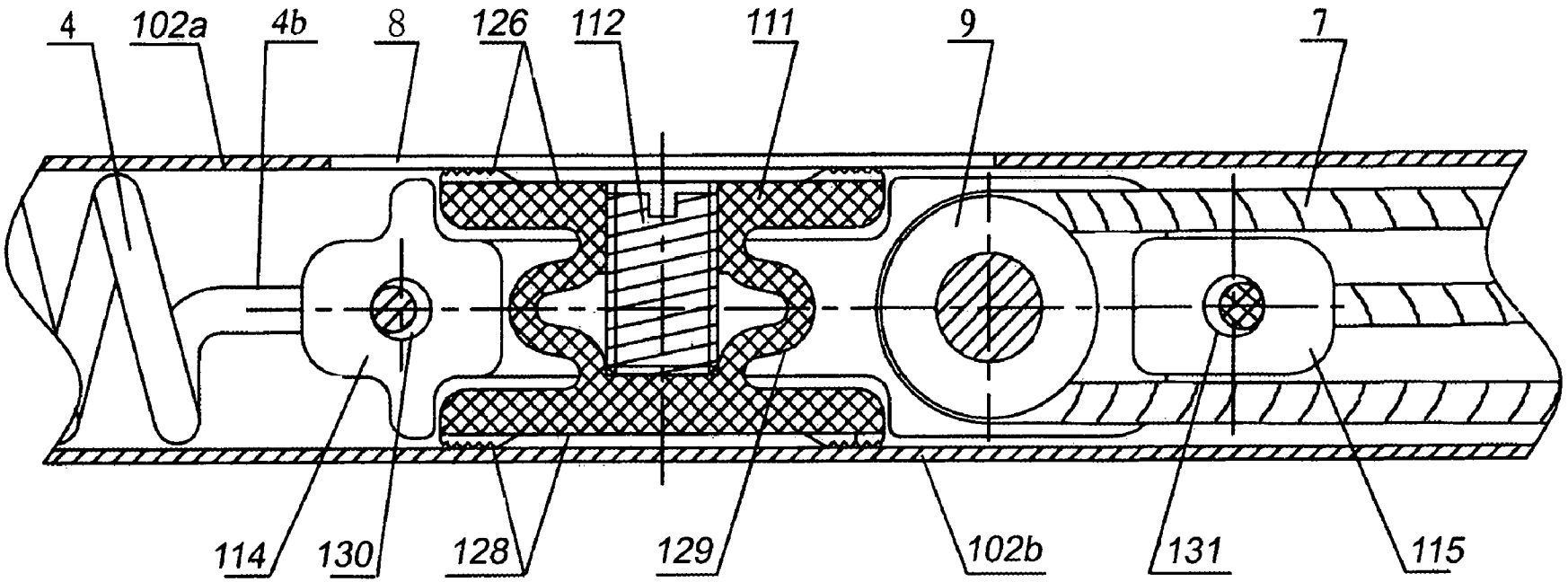
Square shaped tube -- FIG.12

DISCRETIONARILY ADJUSTABLE FRICTION BLOCK AND TACKLE BALANCE SYSTEM AND USES THEREOF

This application claims the benefit of U.S. Ser. No. 60/582,443, filed Jun. 24, 2004. The contents of this application are hereby incorporated in their entireties by reference into this application.

Throughout this application, various publications are referenced. Disclosures of these publications in their entireties are hereby incorporated by reference into this application to more fully describe the state of the art to which this invention pertains. 21

BACKGROUND OF THE INVENTION

Block and tackle window balance system is a type of window balance device which has been known and in use for more than 30 years. U.S. Pat. No. 3,358,404 disclosed a typical construction of the block and tackle window balance system. A drawback of the window balance system of U.S. Pat. No. 3,358,404 is that the friction force cannot be adjusted. Ideally, the window balance assembly will be constructed such that the forces exerted on the window sash from the tension device and gravity will balance when the window is partially open. See U.S. Pat. Nos. 3,054,152, 3,055,044, 4,068,406, 4,089,085. As the window is closed from the partially open position, the tension device is caused to stretch, further increasing the amount of force exerted by the tension device. Conversely, as the window is opened further from the partially open position, the tension device moves closer to its un-stretched position thereby decreasing the amount of force exerted by the tension device See U.S. Pat. Nos. 3,054,152, 3,055,044, 4,068,406, 4,089,085.

However an improperly balanced window sash will not stay wherever it is set, i.e., it will "hop" if overbalanced or "drop" if under-balanced. Others have attempted to remedy this problem by designing, manufacturing and stocking numerous models of window sash balance systems to support a widely varying range of window sizes and weights. Frequently, five or more different spring force scale or tension devices are required for a particular window sash balance system to account for windows or window sashes of varying sizes and weights. Making or storing different models of window sash balance system to account for the different weights and sizes of windows or window sashes adds to the overall cost of window balance systems.

Adjusting friction force to control the balance of windows has been used as a method for overcoming the drawbacks found in many non-adjustable block and tackle balance systems. Many have attempted to improve the adjustable friction force block and tackle balance system. Many patents, such as U.S. Pat. Nos. 3,358,403, 3,358,404, 4,517,766, 4,654,928 and 4,697,304, have also attempted to improve on the problems encountered by the non-adjustable block and tackle balance system. However, in U.S. Pat. No. 4,517,766, adjustment of the friction force cannot be easily performed after the block and tackle balance system has been installed in a window because the operating or access space is too narrow to turn the adjust screw. Moreover, in U.S. Pat. No. 4,654,928, it is possible to adjust the block and tackle balance system after the balance system has been installed in a window, but the friction force can only be set to either low or high. Since the friction force is not adjustable over a wide range, there is no distinct or real reduction in the inventory of window balance systems that must be maintained to account for the variety in window sashes and weight. In U.S. Pat. No. 4,697,304, a rivet is used to adjust the friction drag against balance cord, but the rivet cannot be easily inserted into or taken out of the tube after the balance is installed in a window. Therefore, adjusting the friction drag against the cord is not available. None of the prior block and tackle balance systems have overcome the fundamental issues or problems of using preferably one friction-adjustable block and tackle balance system for balancing window sashes and the like of widely varying sizes and weights.

SUMMARY OF THE INVENTION

It is an object of this invention to provide an improved discretionarily adjustable friction block and tackle balance which can support a wide range of window sash sizes and weights. The adjustable friction block and tackle balance of this invention is based on both U-shaped and square-shaped tube. The desired amount of friction can be adjusted simply, easily and effectively after installation of the adjustable friction block and tackle balance in a window.

In a preferred embodiment, the discretionarily adjustable friction force block and tackle window balance system of this invention comprises a U-shaped tube. There is at least one elongated hole/slit on a surface of the U-shaped tube to provide access to the adjust screw to adjust the friction force between the adjustable break and the opposite inner surfaces of the U-shaped tube. In a preferred embodiment, the adjustable break with an adjust screw is installed inside the floating anchor subassembly which is installed inside the channel of the U-shaped tube.

After the block and tackle balance system has been installed in the window, the adjust screw can be exposed by moving the floating anchor subassembly under the long/elongated hole on the tube. The adjust screw can be easily turned by using a screwdriver or any appropriate tool to splay or retract the left and right plates of the adjustable break to obtain the desired amount of friction force. When the adjust screw is turned in the appropriate direction, the left and right plates of the adjustable break will expand and press tighter against the opposite inner surfaces of the U-shaped tube, thereby increasing the friction force between the adjustable break and the opposite inner surface(s) of the tube. The floating anchor subassembly will become completely stationary if the amount of friction exerted against the opposite inner surface of the tube by the adjustable break is great enough. The adjustable friction force block and tackle balance system of this invention is more versatile than prior art devices. These capabilities and characteristics are just some of the novel and unique features of the present invention that are not found in the block and tackle balance systems known in the prior art.

The principium of this invention as described above can be completely and perfectly applied to a friction force block and tackle balance systems comprising a square-shaped tube by one of ordinary skill in the art following the teaching of this application. Certainly, the structure and design of the adjustable break for a square-shaped tube is slightly different from an adjustable break designed for a U-shaped tube. However, the appropriate modifications are readily apparent to one of ordinary skill in the art following the teaching of this application.

The present invention will be described in connection with preferred embodiments, however, it will be understood that this is no intent to limit the invention to the embodiments described. On the contrary, the intent is to cover all alternatives, modifications, and equivalents as may be included within the spirit and scope of the invention as defined by the appended claims.

DETAILED DESCRIPTION OF THE FIGURES

The accompanying drawing illustrates diagrammatically non-limitative embodiment of the invention. One embodiment of this invention based on a U-shaped tube is shown in FIG. 1 to FIG. 6. Another embodiment of this invention based on a square-shaped tube is shown in FIG. 7 to FIG. 12. FIG. 13 shows an adjustable balance system of the present invention installed on a typical window.

FIG. 1 is a drawing of an adjustable friction force block and tackle window balance system according to this invention having a U-shaped tube, and a floating anchor subassembly with an adjustable friction device.

FIG. 2 is a top view of a balance system according to this invention.

FIG. 3 is a cutaway side elevation view of a balance system according to this invention along the line 3-3 of FIG. 2.

FIG. 4 shows an exploded view of a floating anchor 5 subassembly of a balance system according to this invention adapted for a U-shaped tube.

FIG. 5 is a cutaway view of the floating anchor subassembly according to this invention having an adjustable break with a screw along the line 5-5 of FIG. 3. The adjustable break is shown in the retracted or natural position.

FIG. 6 is a cutaway view that is similar to the FIG. 5 but the screw has been turned downwards into the adjustable break and the adjustable break is splayed. The right and left plates of the adjustable break are pressed against the left and right inside surface of the U-shaped tube to create friction force.

FIG. 7 is a drawing of an adjustable friction force block and tackle window balance system according to this invention having a square-shaped tube, and a floating anchor subassembly with an adjustable friction device adapted for the square-shaped tube.

FIG. 8 is a top view of the balance system according to this invention.

FIG. 9 is a cutaway side elevation view of a balance system according to this invention along the line 9-9 of FIG. 8.

FIG. 10 shows an exploded view of a floating anchor subassembly of a balance system according to this invention adapted for a square-shaped tube.

FIG. 11 is a magnified cutaway view of the floating anchor subassembly according to this having an adjustable break with a screw. The adjustable break is shown in the retracted or natural position.

Figure 13:
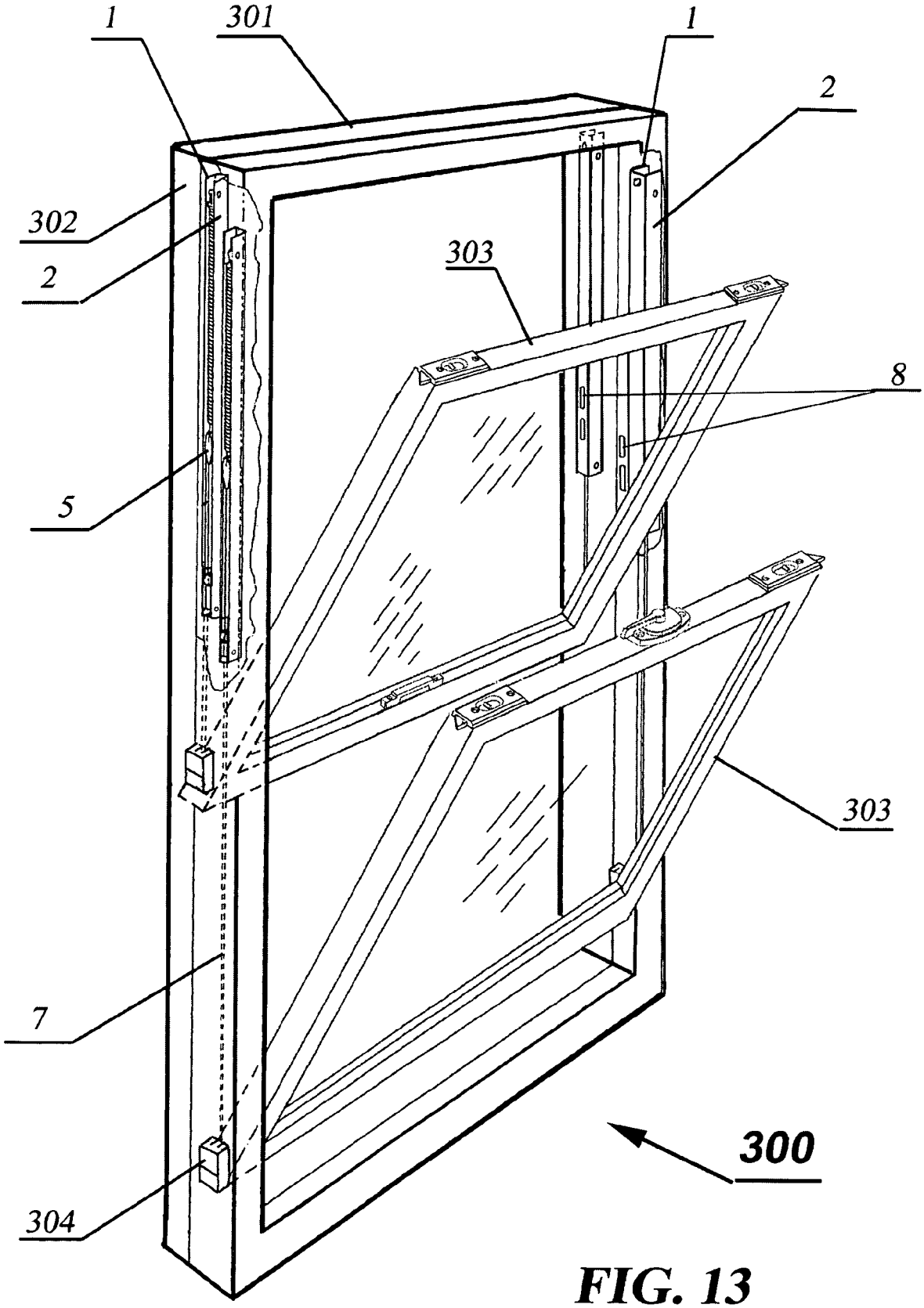

FIG. 12 is a cutaway view of the floating anchor subassembly having an adjustable break with screw. The adjustable break is shown in the extended position. The screw has been turned downwards into the adjustable break and the adjustable break is extended. The top and bottom plate of the adjustable break are pressed against the top and bottom inner-surface of the square-shaped tube to create friction force.

FIG. 13 shows a discretionarily adjustable friction block and tackle balance of the present invention installed on a typical double-hung tilt window. As shown in FIG. 13, the discretionarily adjustable friction block and tackle balance comprises a U-shaped tube.

DETAILED DESCRIPTION OF THE INVENTION

This invention provides an adjustable balance system comprising: a housing for a block and tackle balance; an elastic suspension means, wherein one extremity of the suspension means is anchored to one end of the housing, the other extremity of the suspension means is connected to one extremity of a floating anchor assembly, wherein the floating anchor assembly comprises an adjustable break and at least one roller member; a fixed anchor assembly comprising at least one roller member, wherein one extremity of the fixed anchor assembly is anchored to the other end of the housing; and a cord connected to the other extremity of the floating anchor assembly, wherein the cord extends over at least one roller member of the fixed anchor assembly and over at least one roller member of the floating anchor assembly with the free extremity of the cord extending beyond the other end of the housing. The housing, elastic suspension means, floating anchor assembly, fixed anchor assembly and cord are operatively linked to form the adjustable balance system. In an embodiment, the housing is an elongated tube or casing of appropriate length. In another embodiment, the free extremity of the cord is linked to the window or window sash. In a further embodiment, the housing is attached to the window frame. The orientation of the housing and installation of the adjustable block and tackle balance system is readily apparent to one of ordinary skill in the art following the-teaching of this invention.

In another embodiment, the cord extends over at least one roller member of the fixed anchor assembly and at least one roller member of the floating anchor assembly in an arrangement that covers at least 1½ loop. In a further embodiment, the cord extends over at least two-roller member of the fixed anchor assembly and at least two-roller member of the floating anchor assembly in an arrangement that covers at least 2½ loops.

In a further embodiment, the roller member is a roller, a non-rotating pulley or a grooved cylindrical bar. As used herein, roller includes but is not limited to radial roller, cylindrical roller, ball bearing roller, pulley roller, and roller with compound plastic and/or groove on the outer ring. In a further embodiment, the roller has a grooved surface.

As used herein, the elastic suspension means includes but is not limited to coil springs, suspension springs, hydraulic and gas springs, natural or synthetic rubbers, and elastic polymers.

In an embodiment, the housing is an elongated tube, casing or channel. In another embodiment, the tube has at least three sides. In a further embodiment, the tube, casing or channel is squared-shaped, rectangular-shaped, or 4-sided. In a further embodiment, tube, casing or channel is fabricated from suitable materials including but not limited to injection-molded thermoplastic, extrusion aluminum alloy, die-cast metal alloy and rolled or stamped metal. The tube, casing or channel comprises at least one slit or hole on a surface for adjusting the adjustable break.

In an embodiment, the adjustable break of the present invention comprises a left and right plate or a top plate and a bottom plate for making contact with the inner walls of the tube. In a further embodiment, the surface of the plates is flat or is provided with serrations. In a further embodiment, the serrations partially cover the surface of the plates. In a further embodiment, the serrations cover the entire surface of the plates.

This invention provides an adjustable balancing system comprising an adjustable break.

This invention provides an adjustable balance system, comprising: a housing, an elastic suspension means, a floating anchor assembly, a fixed anchor assembly and a cord means operatively linked to form the adjustable balance system, wherein the floating anchor assembly comprises an adjustable break. In an embodiment, the adjustable break is adapted for mounting in a suitable position or location within the housing which is readily apparent to one of ordinary skill in the art following the teaching of this application. As used herein, cord means includes but is not limited to cord, wire, string, cable, tape, strip, chain, spring, pulley system, extension spring and the like.

This invention provides a method for adjusting an adjustable window block and tackle balance system, comprising: moving a window sash to an appropriate position, wherein the adjust screw is exposed under a hole or slit on a surface of the tube; holding the window sash at the appropriate position; and adjusting the adjust screw through a hole or slit to create appropriate friction force between the adjustable break and the inner surface of the tube to counter balance the window sash or the weight of the window.

This invention provides an adjustable balance system, comprising a housing and an adjustable break, wherein means are provided for adjusting the friction force between an inner surface of the housing and the adjustable break. In an embodiment, the adjustable balance system is suitable for use with window sashes or windows of various weights or sizes. In another embodiment, the adjustable break is adapted for 3-sided or 4-sided housing.

This invention provides an adjustable balance system, comprising a housing and an adjustable break, wherein means are provided for adjusting the friction force between an inner surface of the housing and the adjustable break and wherein the desired friction force is determined by the weight or size of the window sash or window connected to the adjustable balance system.

This invention provides an adjustable balance system comprising a housing and a breaking means for contacting a inner surface of the housing, wherein means are provided for adjusting the friction force between the inner surface of the housing and the breaking means and wherein the desired friction force is determined by the weight or size of the window sash or window connected to the adjustable balance system.

As used herein, breaking means include but is not limited to flexible pads fabricated from plastic, ceramic, wood, metal or synthetic polymer adapted for contacting a surface of a housing. As used herein, means for adjusting the friction force between the inner surface of the housing and the breaking means includes but is not limited components or parts, such as a screw, clamp, or knob, suitable for expanding or retracting the breaking means.

Other advantages and aspects of the present invention will become apparent upon reading the following examples.

EXEMPLIFICATION

The invention being generally described, will be more readily understood by reference to the following examples which are included merely for purposes of illustration of certain aspects and embodiments of the present invention, and are not intended to limit the invention.

Example 1

Adjustable Balance System Having a U-shaped Tube and Corresponding Components For a general understanding of an adjustable balance system 1 of the present invention having a U-shaped tube, reference is made to the drawings FIG. 1 to FIG. 6.

An adjustable balance system 1 of this invention as shown in FIG. 1 comprising a U-shaped elongated tube 2, a coil spring 4, a floating anchor subassembly 5, a fixed anchor subassembly 6, a cord 7 and a hook 10.

The U-shaped tube 2 has one topside 2*a* and two sidewalls 2*c*, shown in FIG. 1 and FIG. 2. There is on the topside 2*a* at least one hole or slit referred to herein as adjust hole 8 for exposing and for adjusting the adjust screw 12. The adjust screw 12 is rotatably mounted on the adjustable break 11 for splaying or contracting the adjustable break 11. The adjustable break increases or decreases the friction force between the inner surface of the tube and the floating anchor subassembly 5. In an embodiment, the floating anchor subassembly 5 and the fixed anchor subassembly 6 each comprises at least one roller unit 9 rotatably mounted in the floating anchor subassembly 5 and the fixed anchor subassembly 6. In another embodiment, the floating anchor subassembly 5 comprises two roller units 9. See FIG. 1-4.

The coil spring 4 has opposite extremity 4*a* and 4*b*. One extremity 4*a* of the coil spring 4 is securely attached to the tube by suitable fastening means, such as a rivet or pin 3*a*. The rivet or pin 3*a* is securely attached to the sidewalls 2*c* on one end of the tube 2 or housing. The other extremity 4*b* of the coil spring 4 is connected to an extremity 14 of the floating anchor subassembly 5. In an embodiment, extremity 4*b* is connected to extremity 14 through a combined aperture 30. On the other end of the U-shaped tube 2, a fixed anchor subassembly 6 is securely attached to the tube by suitable fastening means such as a rivet or pin 3*b*. The rivet or pin 3*b* is securely attached to the sidewalls 2*c*.

The cord 7 is connected to one extremity 15 of the floating anchor subassembly 5, and is secured thereto by suitable fastening means such as a knot. In an embodiment, the cord extends over the surfaces of the roller unit(s) 9 on the floating anchor subassembly 5 and the fixed anchor subassembly 6 in an arrangement which covers at least 1½ loops with the free extremity of cord 7 extending from the end of the tube 2 beyond the roller unit 9 of the fixed anchor subassembly 6. In another embodiment, the roller 9 has a grooved surface. In a further embodiment, the cord 7 makes 2½ loops over the surface of the roller units 9 of the fixed anchor subassembly 6 and the floating anchor assembly 5.

The free end 33 of the cord 7 carries a hook member 10 secured to the end of the cord by suitable fastening means such as a knot 32. In an embodiment, the hook member 10 is attached to the free end 33 of the cord by crimping or gluing. Cord 7 will preferably be made of a cloth material, wire, nylon, or other suitable synthetic fiber well known in the art, and the roller units 9 preferably are made of suitable metal, plastic or other suitable polymer material well known in the art.

An adjustable break 11 with an adjust screw 12 is shown in both FIG. 5 and FIG. 6. In an embodiment, the adjustable break 11 is mounted on the floating anchor subassembly 5. The adjustable break 11 may be mounted in various suitable locations within the tube which is readily apparent to one of ordinary skill in the art following the teaching of this application. FIG. 4 illustrates a diagram for assembling a floating anchor subassembly 5 of this invention. The floating anchor subassembly comprises a main floating anchor member 5*a*, a fit floating anchor member 5*b*, an adjustable break 11, an adjust screw 12 and two roller units 9.

The adjustable break 11 with an adjust screw 12, designed for use on U-shaped tube, represents an important feature of the present invention. As used herein, the adjust screw 12 includes but is not limited to Phillips, hex, square (Robertson drive), torx or slot flat head screw. In an embodiment, the adjust screw comprises a flat head 12*a*, a cone 12*b*, an outside thread 12*c* and a flat bottom 12*d*. The adjustable break 11 has an inside cone-face and an inside thread hole 27 which can be correspondingly fitted with an adjust screw 12. The adjustable break comprises a right plate 26, a left plate 28, a connection member 34, and a center groove 25 having an appropriate height and width. In an embodiment, the surfaces of the left plate 28 and right plate 26 are flat. In another embodiment, the surfaces of the left plate 28 and right plate 26 are serrated to augment the friction force between the adjustable break 11 and the inner surfaces of the tube 2. In a further embodiment, the lower outer portions of the right plate 26 and left plate 28 contain indentations 35*a* and 35*b*. In a further embodiment, the thickness of indentations 35*a* and 35*b* is less than the thickness of the right plate 26 and left plate 28, respectively. In a further embodiment, the U-shaped adjustable break 11 is similar to a U-shaped spring or U-shaped member comprising opposing plates which can be splayed and retracted. In a further embodiment, the U-shaped type adjustable break is molded or fabricated out of a single piece of suitable material. In a further embodiment, the adjustable break is assembled from component parts. In a further embodiment, the adjustable break is assembled from at least two parts, wherein the parts are made of similar or different materials.

In a further embodiment, the adjustable break 11 is fabricated from plastic, metal and/or suitable synthetic polymer material. In a further embodiment, the adjust screw 12 is fabricated from suitable plastic, metal, such as plastic, aluminum or zinc alloy, or steel, and/or suitable synthetic polymer material.

As shown in FIG. 4, the main floating anchor member 5*a* comprises a wall 16*a* having opposite, bulgy extremity 14*a* and 15*a*. Extremity 14*a* and 15*a* comprises aperture 30*a* and 31*a*, respectively. The wall 16*a* comprises a lower wall 20*a* and a taller wall 21*a*. Opposite the main floating anchor member 5*a* is the fit floating anchor member 5*b*. Similar to the main floating anchor member 5*a*, the fit floating anchor member 5*b* comprises a wall 16*b* having opposite, bulgy extremity 14*b* and 15*b*. Extremity 14*b* and 15*b* comprises aperture 30*b* and 31*b*, respectively. The wall 16*b* comprises a lower wall 20*b* and a taller wall 21*b*. In an embodiment, the size and height of the lower wall 20*a* and 20*b* are similar, and the size and height of the taller wall 21*a* and 21*b* are also similar. In another embodiment, the main floating member further comprises a pin 17 extending from the taller wall 21*a* for connecting the main floating member 5*a* and the fit floating member 5*b*.

In a further embodiment, the pin 17 is a cylindrical rod or shaft with a squared-shaped end 18 or tip which can be inserted into the corresponding squared-shaped hole 24 or opening located on the fit floating anchor member 5*b*. In a further embodiment, the roller unit(s) 9 is rotatably mounted on the pin 17 before the main floating member 5*a* and the fit floating anchor member 5*b* are assembled. In a further embodiment, the pin has a triangular- or other polygonal-shaped tip, and the fit floating anchor member 5*b* has a correspondingly shaped hole 24 or opening for connecting the main floating member 5*a* and the fit floating member 5*b*.

Prior to assembling the adjustable break 11, a roller unit 9 is inserted into the cylindrical pin 17, and the adjustable break 11 is mounted in the space or recess formed by extremity 14*a*, 15*a*, 14*b* and 15*b* and wall 16*a* and 16*b*. The main floating anchor member 5*a* and fit floating anchor member 5*b* can be joined together, for example, by riveting the end 18 or tip of the pin 17 after the end 18 or tip has been inserted into the corresponding hole 24 or opening on the fit floating anchor member 5*b*. In an embodiment, the main floating anchor member 5*a* and fit floating anchor member 5*b* are attached by suitable attaching means such as adhesive, welding, screws, riveting or the like.

Extremity 14*a* and 14*b* is combined to form extremity 14. Extremity 15*a* and 15*b* is combined to form extremity 15. Aperture 30*a* in extremity 14*a* and the aperture 30*b* in extremity 14*b* are combined to form aperture 30. Aperture 31*a* in extremity 15*a* and the aperture 31*b* in extremity 15*b* are combined to form aperture 31.

After the floating anchor subassembly 5 is assembled the adjustable break 11 is securely attached to the floating anchor subassembly 5. In an embodiment, the shape and size of indentation 35*a* and 35*b* under right plate 26 and left plate 28 of the adjustable break 11, respectively, corresponds to the shape and size of the lower wall 20*a* and 20*b*, and the adjustable break 11 is securely held by the lower wall 20*a* and 20*b*. See FIG. 5.

Moving the window sash also causes the floating anchor subassembly 5, which comprises the adjustable break 11, to move. When the floating anchor subassembly 5 is moved to a position just below a long/elongated hole or slit, the adjust screw 12 is exposed.

FIG. 5 and FIG. 6 show the adjustable break 11 with an adjust screw 12 mounted inside the floating anchor subassembly 5. In FIG. 5, the adjustable break 11 is in the fully retracted position. In this position the flat head 12*a* of the screw 12 is flat with the top-face 23 of the adjustable break 11, and the right plate 26 and left plate 28 of the adjustable break 11 are in the retracted or natural position since the right plate 26 and left plate 28 of the adjustable break 11 do not make contact with the inner surface of the U-shaped tube. In the retracted or natural position, there is a space or gap between the right plate 26 and inner surface of the U-shaped tube, and between the left plate 28 and the inner face of the U-shaped tube. In the retracted or natural position, the floating anchor subassembly 5 can move freely inside the U-shaped tube 2 with relatively minute friction force between the inner surface of the tube 2 and the floating anchor subassembly 5.

FIG. 6 shows the adjustable break 11 in the splayed position. In this position, the screw 12 has been turned or rotated downwards by a screwdriver or suitable tool, and the cone 12*b* pushes against the corresponding inside cone-face of the thread hole 27 causing the right plate 26 and left plate 28 to expand outward. The right plate 26 and left plate 28 makes contact with the inner surfaces of the U-shaped tube 2 causing the friction force between the adjustable break 11 and the U-shaped tube 2 to increase. When the screw 12 is rotated upwards or loosened to the position where its flat head 12*a* is flat with the top-face 23 of the adjustable break 11, the right plate 26 and left plate 28 are fully retracted. The adjustable break 11 returns to the state as shown in FIG. 5. The flat bottom 12*d* of the screw 12 does not protrude through the bottom of the connection member 34 of the adjustable break 11 in the state as shown in FIG. 5 and in the state as shown in FIG. 6.

Example 2

Adjustable Balance System Having a Square-shaped Tube or Rectangular-shaped Tube and Corresponding Components In an embodiment of the adjustable friction force block and tackle window balance system 101 of this invention, the tube 102 is square-shaped or rectangular-shaped. An adjustable friction force block and tackle window balance system as shown in FIG. 7 comprises an elongated tube 102 having four sides, a coil spring 4, a floating anchor subassembly 105, a fixed anchor subassembly 6, a cord 7 and a hook 10.

In an embodiment, all the components of the adjustable balance system as shown in FIG. 7 are similar to the parts of the adjustable balance system as shown in FIG. 1, except for the floating anchor subassembly 105 and the square-shaped or rectangular-shaped tube 102. The floating anchor subassembly 105 as shown in FIG. 7 is specially designed for the square-shaped or rectangular-shaped tube 102. The square-shaped or rectangular-shaped tube 102 will be collectively referred to herein as 4-sided tube.

The method for assembling a block and tackle balance system based on the square-shaped or 4-sided tube 102 is similar to a block and tackle balance system based on the U-shaped tube 2 as described above.

In accordance with an embodiment of the present invention, the tube of the window balance system is a square-shaped or 4-sided tube 102 having a topside 102*a*, a bottom side 102*b* and two sidewalls 102*c*. There is on the topside 102*a* at least one hole or slit referred to herein as adjust hole 8 for exposing and for adjusting the adjust screw 112. The adjust screw 112 is rotatably mounted on the adjustable break 111 for expanding or contracting the adjustable break 111 mounted inside the floating anchor subassembly 105. See FIG. 7 to FIG. 12. In an embodiment, the floating anchor subassembly 105 and the fixed anchor subassembly 6 each comprises at least one roller unit 9 rotatably mounted on the fixed anchor subassembly 6 and the floating anchor subassembly 105.

The adjustable break 111 with an adjust screw 112 designed for used on 4-sided tube represents an important aspect of the present invention. FIG. 10 illustrates a method for assembling a floating anchor subassembly 105 comprising a main floating anchor member 105*a*, a fit floating anchor member 105*b*, an adjustable break 111, an adjust screw 112 and two roller units 9. The main floating anchor member 105*a* comprises a wall 116*a* having opposite, bulgy extremity 114*a* and 115*a*. Extremity 114*a* and 115*a* comprises aperture 130*a* and 131*a*, respectively. The wall 116*a* comprises a lower (narrower) wall 120*a* and a taller (wider) wall 121*a*. Opposite the main floating anchor member 105*a* is the fit floating anchor member 105*b*. Similar to the main floating anchor member 105*a*, the fit floating anchor member 105*b* comprises a wall 116*b* having opposite, bulgy extremity 114*b* and 115*b*, respectively. Extremity 114*b* and 115*b* comprises aperture 130*b* and 131*b*, respectively. The wall 116*b* comprises a lower (narrower) wall 120*b* and a taller (wider) wall 121*b*. In an embodiment, the size and height of the lower (narrower) wall 120*a* and 120*b* are similar, and the size and height of the taller (wider) wall 121*a* and 121*b* are also similar. In another embodiment, the main floating member further comprises a pin 117 extending from the taller (wider) wall 121*a* for connecting the main floating member 105*a* and the fit floating member 105*b*.

In a further embodiment, the pin 117 as a cylindrical rod or shaft with a squared-shaped end 118 or tip which can be inserted into the corresponding squared-shaped hole 124 or opening located on the fit floating anchor member 105*b*. In a further embodiment, the roller unit(s) 9 is rotatably mounted on the pin 117 before the main floating member 105*a* and the fit floating anchor member 105*b* are assembled. In a further embodiment, the pin 117 has a triangular- or other polygonal-shaped tip, and the fit floating anchor member 105*b* has a correspondingly shaped hole 124 or opening for connecting the main floating member 105*a* and the fit floating member 105*b*.

The adjustable break 111 comprises a top plate 126 and a bottom plate 128. The top plate 126 and the bottom plate 128 are joined together by U-shaped members 129. In an embodiment, the top plate 126 and the bottom plate 128 are joined together by suitable connecting means including but not limited to spring, resilient metal, plastic, rubber or synthetic polymer member, or flexible metal. In another embodiment, the two U-shaped members 129 are joined by a U-shaped spring which can be splayed and retracted. In a further embodiment, the adjustable break 111 is fabricated from a suitable metal, plastic or synthetic polymer or the like. In a further embodiment, the U-shaped type adjustable break is molded or fabricated out of a single piece of suitable material. In a further embodiment, the adjustable break is assembled from component parts. In a further embodiment, the adjustable break is assembled from at least two parts, wherein the parts are made of similar or different materials. In a further embodiment, the adjust screw 112 is fabricated from a suitable metal such as aluminum or zinc alloy, or steel, plastic or synthetic polymer or the like.

In an embodiment, the width of the U-shaped thin members 129 is narrower than that of the top plate 126 and the bottom plate 128, and the distance between the top plate 126 and bottom plate 128 closely correlates to the height of the lower wall 120*a* and 120*b*. When assembling the adjustable break, the roller unit 9 is inserted into the cylindrical pin 117, and the adjustable break 111 is mounted in the space or recess formed by extremity 114*a*, 115*a*, 114*b* and 115*b*, and wall 116*a* and 116*b*. The main floating anchor member 105*a* and fit floating anchor member 105*b* can be joined together, for example, by riveting the end 118 or tip of the pin 117 after the end 118 or tip has been inserted into the corresponding square hole 124 or opening on the fit floating member 105*b*.

Extremity 114*a* and 114*b* is combined to form extremity 114. Extremity 115*a* and 115*b* is combined to form extremity 115. Aperture 130*a* and aperture 130*b* are combined to form aperture 130. Aperture 131*a* and aperture 131*b* are combined to form aperture 131. After the floating anchor assembly 105 is assembled, the adjustable break 111 is securely attached to the floating anchor subassembly 105.

In an embodiment, the adjust screw 112 comprises a slot flat head screw having a flat head 112*a*, an outside thread 112*c* and a flat bottom 112*d*. In another embodiment, the top plate 126 of the adjustable break 111 comprises an inside thread hole 127 which can be fitted with an adjust screw 112. Generally, the surfaces of the top plate 126 and the bottom plate 128 are flat, but if necessary, these surfaces can be provided with serrations or bulges to augment the friction force between the adjustable break 111 and the inner surfaces of the tube 102. In a further embodiment, the surfaces of top plate 126 and the bottom plate 128 are provided with serrations which cover their entire surfaces.

Moving the window sash also causes the floating anchor subassembly 105, which contains the adjustable break 111, to move. When the floating anchor subassembly is moved to a position just under a long/elongated hole, the adjust screw 112 is exposed. FIG. 11 and FIG. 12 show an adjustable break 111 with an adjust screw 112 mounted on a floating anchor subassembly 105. FIG. 11 shows an adjustable break 111 mounted on a floating anchor subassembly 105. In FIG. 11, the adjustable break is in the retracted or natural position. In the retracted position, the top and bottom plates of the adjustable break 111 are fully retracted, the head 112*a* of screw 112 is flat with the outside-face of the top plate 126, and the flat bottom 112*d* of the screw 112 lightly touches the inside-face of the button plate 128 of the adjustable break 111. In the retracted position, the top 126 and bottom 128 plates of the adjustable break 111 do not make contact with the inner surface of the tube, and the floating anchor subassembly 105 can move freely inside the tube 102 with relatively small friction force between the inner surface of the tube and the floating anchor subassembly 105. FIG. 12 shows a floating anchor subassembly 105 in the extended position. In this position, the screw 112 has been turned downwards using a screwdriver or a suitable tool, causing the top plate 126 and bottom plate 128 to expand outward. The top plate 126 and the bottom plate 128 of the adjustable break make contact with the inner-surfaces of the tube 102 creating friction force between the adjustable break 111 and the square-shaped tube 102. When turning the adjust screw is rotated upwards or returning the adjust screw 112 to the position where its head 112*a* is flat or level with the top-face 126 of the adjustable break 111, the top plate 126 and bottom plate 128 of the adjustable 111 are fully retracted. The floating anchor subassembly 105 returns to the retracted state as shown in FIG. 11.

FIG. 13 shows an exemplary embodiment for the present invention installed on a typical double-hung tilt window 300 formed by frame 301, upper window sash 302 and a lower window sash 303. The discretionarily adjustable friction block and tackle balance 1 of the present invention comprising a U-shaped tube 2 is installed inside the channel of the frame 301. As shown in FIG. 13, the surface of the U-shaped tube 2 facing the sash 302 and 303 comprises at least one elongated adjust hole 8. The end of the cord 7 is connected to the balance shoe 304 which is connected to the window sash. In an embodiment, sash 302 and 303 are moved downward and tilted out at an angle from the window frame 301 to expose the elongated adjust hole 8 on the block and tackle balance 1. When the sash is moved downward to a suitable position where the floating anchor member 5 is just below the elongated adjust hole 8, the adjust screw 12 will be exposed, and the screw 12 can be easily adjusted to obtain a desired friction force between the inner surface of the tube 2 and the floating anchor subassembly 5.

In a preferred embodiment of this invention, the tube is a U-shaped or square-shaped tube or a 4-sided tube. The desired amount friction force between the adjustable break and the inner surfaces of the tube can be easily adjusted. The adjustable break will remain completely stationary if it is fully extended or if the friction force between the adjustable break and the inner surfaces of the tube is greater than the force acting on the floating anchor subassembly.

EQUIVALENTS

Those skilled in the art will recognize, or be able to ascertain using no more than routine experimentation, many equivalents to the specific embodiments of the invention described herein. Such equivalents are intended to be encompassed by the following claims.

What is claimed is:

1. An adjustable balance system, comprising:

a housing having at least one long hole in a wall of the housing, and enclosing an elastic suspension means, a floating anchor assembly and a fixed anchor assembly;

wherein one extremity of the suspension means is anchored to a first end of the housing, the other extremity of the suspension means is connected to a first extremity of the floating anchor assembly, wherein the floating anchor assembly comprises at least one first roller member and a brake comprising two opposing plates joined on one end by a connection member, wherein the inner surfaces of the two plates form an inside thread hole to accommodate a screw, and the outer surfaces of the two plates are aligned with two opposite walls of the housing, wherein the head of the screw is on the same side as the long hole of the housing, and wherein rotating the screw adjusts the friction force between said opposite walls and the plates; and wherein the fixed anchor assembly comprises at least one second roller member, wherein one extremity of the fixed anchor assembly is anchored to a second end of the housing; and a cord connected to a second extremity of the floating anchor assembly, wherein the cord extends over said second roller member mounted on the fixed anchor assembly and over said first roller member mounted on the floating anchor assembly, wherein the free extremity of the cord extends beyond the second end of the housing.

2. The adjustable balance system of claim 1, wherein the housing is an elongated tube or casing.

3. The adjustable balance system of claim 1, wherein the housing is U-shaped or 4-sided rectangular-shaped housing.

4. The adjustable balance system of claim 1, wherein the brake is held by the floating anchor assembly.

5. The adjustable balance system of claim 1, wherein the brake is sized for 3-sided or 4-sided housing.

6. The adjustable balance system of claim 1, wherein the brake is a single piece molded or fabricated from one material.

7. The adjustable balance system of claim 1, wherein the brake is assembled from at least two parts, and wherein the parts are made of similar or different materials.

8. The adjustable balance system of claim 1, wherein the surfaces of the plates are provided with serrations to produce a desired friction force.

9. The adjustable balance system of claim 8, wherein the surfaces of the plates are partially or completely covered with serrations.

10. A method for adjusting the adjustable balance system of claim 1, comprising:

moving a window sash to a position wherein the screw of the adjustable balance system is visible through the at least one long hole of the housing; and rotating the screw to produce a desired friction force between the opposing plates and the inner walls of the housing to counter-balance the weight of the window sash.

11. An adjustable balance system, comprising:

a housing having at least one long hole in a wall of the housing, and enclosing an elastic suspension means, a floating anchor assembly and a fixed anchor assembly;

wherein one extremity of the suspension means is anchored to a first end of the housing, the other extremity of the suspension means is connected to a first extremity of the floating anchor assembly, wherein the floating anchor assembly comprises at least one first roller member and a brake comprising two opposing plates aligned with two opposite walls of the housing and joined back-to-back by a U-shaped connection member, wherein there is a threaded hole in the first opposing plate and the connection member to accommodate a screw which can reach the second opposing plate, wherein the head of the screw is on the same side as the long hole of the housing, and wherein rotating the screw adjusts the friction force between said opposite walls and said opposing plates; and wherein the fixed anchor assembly comprises at least one second roller member, wherein one extremity of the fixed anchor assembly is anchored to a second end of the housing; and a cord connected to a second extremity of the floating anchor assembly, wherein the cord extends over said second roller member mounted on the fixed anchor assembly and over said first roller member mounted on the floating anchor assembly, wherein the free extremity of the cord extends beyond the second end of the housing.

12. The adjustable balance system of claim 11, wherein the housing is an elongated tube or casing.

13. The adjustable balance system of claim 11, wherein the housing is 4-sided rectangular-shaped housing.

14. The adjustable balance system of claim 11, wherein the brake is held by the floating anchor assembly.

15. The adjustable balance system of claim 11, wherein the brake is sized for 4-sided housing.

16. The adjustable balance system of claim 11, wherein the brake is a single piece molded or fabricated from one material.

17. The adjustable balance system of claim 11, wherein the brake is assembled from at least two parts, and wherein the parts are made of similar or different materials.

18. The adjustable balance system of claim 11, wherein the surfaces of the plates are provided with serrations to produce a desired friction force.

19. The adjustable balance system of claim 18, wherein the surfaces of the plates are partially or completely covered with serrations.

20. A method for adjusting the adjustable balance system of claim 11, comprising:

moving a window sash to a position wherein the screw of the adjustable balance system is visible through the at least one long hole of the housing; and rotating the screw to produce a desired friction force between the opposing plates and the inner walls of the housing to counter-balance the weight of the window sash.

* * * * *

UNITED STATES PATENT AND TRADEMARK OFFICE

CERTIFICATE OF CORRECTION

PATENT NO. : 7,568,260 B2
APPLICATION NO. : 11/158561
DATED : August 4, 2009
INVENTOR(S) : Mingze Wu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 934 days.

Signed and Sealed this

Seventh Day of September, 2010

David J. Kappos

David J. Kappos
*Director of the United States Patent and Trademark Office*